United States Patent [19]

Drumm

[11] Patent Number: 4,490,872

[45] Date of Patent: Jan. 1, 1985

[54] SPIRAL BRUSH SECTION

[76] Inventor: Arthur E. Drumm, 20042 State Rt. 4, Marysville, Ohio 43030

[21] Appl. No.: 609,553

[22] Filed: May 11, 1984

Related U.S. Application Data

[63] Continuation-in-part of Ser. No. 556,274, Nov. 20, 1983.

[51] Int. Cl.[3] ..... A46B 7/10

[52] U.S. Cl. ..... 15/182; 300/21

[58] Field of Search ..... 15/179, 181, 182, 183, 15/79 R, 79 A; 300/2, 21

[56] References Cited

U.S. PATENT DOCUMENTS

| | | | |
|---|---|---|---|
| 2,349,643 | 5/1944 | Wesemeyer | 15/182 |
| 2,734,210 | 2/1956 | Crevier | 15/182 |
| 2,757,401 | 8/1956 | Peterson | 15/182 |
| 2,941,223 | 6/1960 | Klauer | 15/79 |
| 3,107,382 | 10/1963 | Tilgner | 15/182 |
| 3,357,562 | 12/1967 | Sherman, Jr. | 210/196 |
| 3,688,335 | 9/1972 | Clark | 15/182 |
| 3,812,551 | 5/1974 | Mortensen | 15/179 |
| 3,900,915 | 8/1975 | Rosseau | 15/182 |
| 4,267,616 | 5/1981 | Hunt | 15/182 |

*Primary Examiner*—Peter Feldman

*Attorney, Agent, or Firm*—William V. Miller

[57] ABSTRACT

A helical brush section consisting of a split tubular support or drum. The drum is offset at the split when the brush strip is helically wound thereon with its ends corresponding to the shoulders at the ends of the offset drum. Then the section is subjected to axial pressure to restore the drum to cylindrical form which distorts and flattens the ends of the brush strip inwardly substantially flush with the drum ends. Multiples of this resulting section are adapted to be disposed on a mandrel with their adjacent edges and shoulders in axially-abutting relationship to form a continuous helical rotary brush with a minimum of bristle gaps at the flattened ends of the brush strips.

12 Claims, 9 Drawing Figures

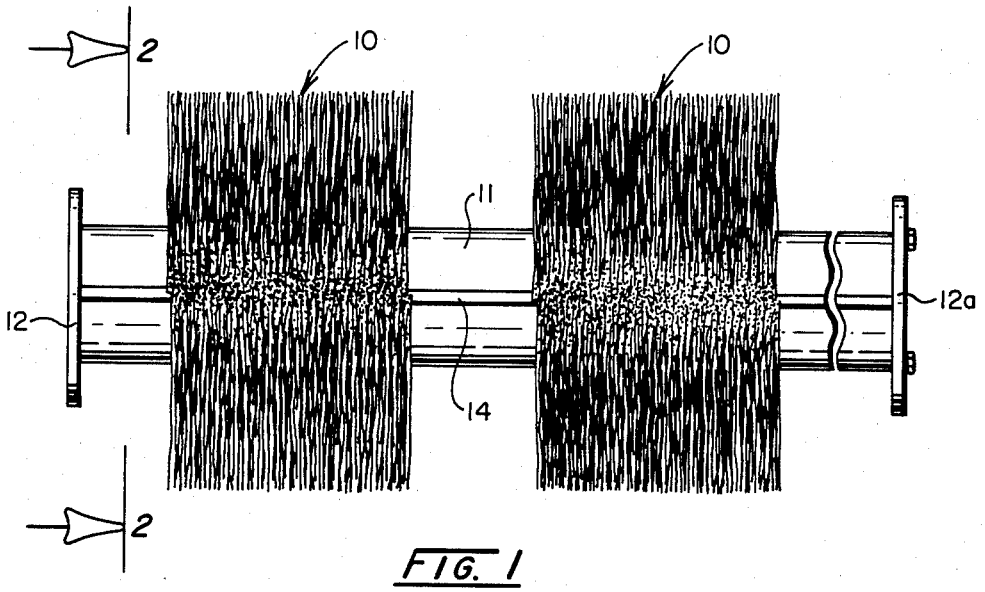
FIG. 1
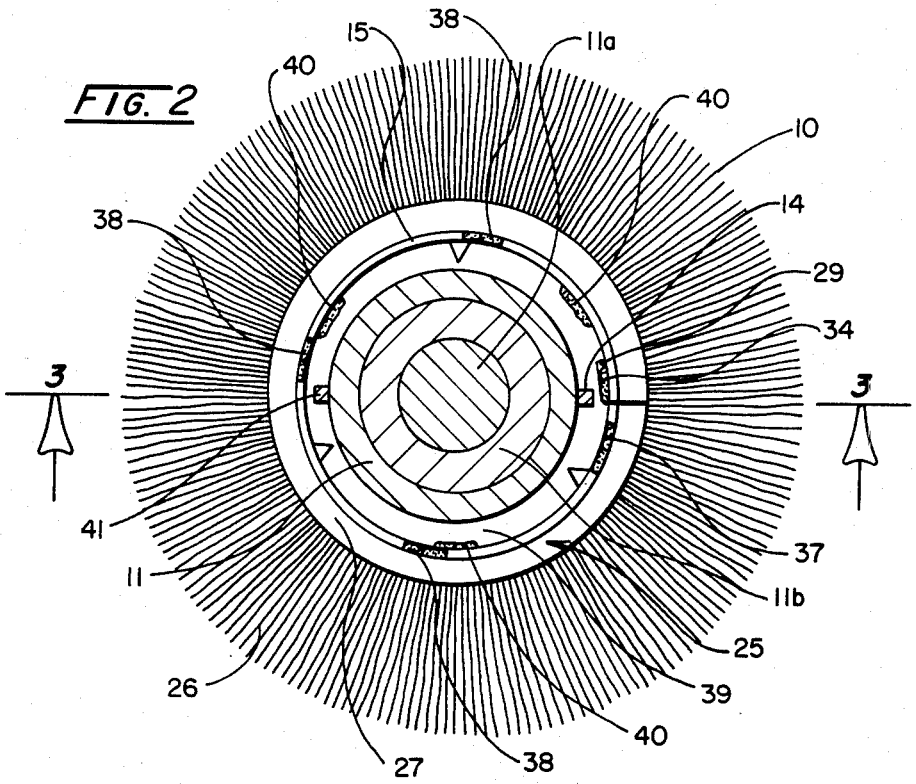

SPIRAL BRUSH SECTION

This application is a continuation-in-part of copending application Ser. No. 556,274, filed Nov. 20, 1983.

BACKGROUND OF THE INVENTION

In the copending application there is disclosed a spiral or helical brush section adapted to be used in multiples of axially-interfitting or nesting sections to complete a rotary brush of desired length. Each section is made of a relatively short split tube section or drum which has its ends offset at its joint to form contact shoulders so that the shouldered end of one section will interfit with and engage the shouldered end of the adjacent section when slipped axially on the mandrel. Each section has a brush strip helically wound thereon which consists of a channel having U-shaped bristles disposed thereon. The bristles are retained in the channel by means including a retaining wire which may be used as an aid in locking the channel to the offset end of the tube. In placing the sections on the mandrel the sections must be rotated to position them properly axially so that the adjacent sections interfit and there will be no gaps in the bristles at the adjacent ends of the bush strips of interlocking sections.

Summary of the Invention

The present invention provides similar brush sections that carry the helical brush strips but before mounting on the mandrel the sections are subjected to axial pressure which eliminates the offset of the tube or drum and its resulting shoulders and flattens the corresponding ends of the channels so as to substantially eliminate the shoulders at those ends of the brush strips. This will make it unnecessary to position sections so that the ends interlock while creating a minimum of gap in bristles at the end of the bristle strips of adjacent brush sections when mounted on the mandrel.

BRIEF DESCRIPTION OF THE DRAWINGS

The best mode contemplated in carrying out this invention is illustrated in the accompanying drawings in which:

FIG. 1 is a side view showing a pair of brush sections made according to this invention being slipped over a mandrel;

FIG. 2 is an enlarged transverse section taken along line 2—2 of FIG. 1;

FIG. 6 A is an enlarged detail showing the minimum gap at the end of the flattened or crushed channel end of the brush strip of FIG. 6; and, FIG. 7 is a side elevational view with bristles partially removed to show that adjacent sections need not be angularly aligned on the mandrel.

With specific reference to the drawings, the spiral or helical brush sections of this invention are indicated generally by the numeral 10. In FIG. 1, two of these sections are shown being slipped on a hollow tubular mandrel 11 of a common type which has a fixed stop collar 12 at one end and a removable one 12*a* at the other end. The mandrel 11 may have keys or splines 14 extending its length. Ordinarily in the prior art an elongated heavy brush section is mounted on and driven by the mandrel but, according to this invention, the rotary brush is made up of a plurality of short axial sections 10 having their adjacent ends in contact to form a complete brush substantially without gaps. The mandrel may be carried by a shaft 11*a* to which it is keyed and supported by bushings 11*b*.

As shown in FIG. 4 each section 10 is made of a sheet metal drum 15 formed from a rolled tube section which originally was cylindrical and which is split longitudinally at a joint 16. The joint is temporarily fastened together, such as by tack welds 17, but the ends of the sheet are offset before welding to form shoulders 21 and 22 at opposite ends of the tube or drum 15. Thus, each end of the drum 15 has a helically-extending edge 21*a* or 22*a* terminating in a longitudinally extending shoulder 21 or 22. The shoulders 21 and 22 are each provided with a wire-anchoring notch 23.

Figure 5:
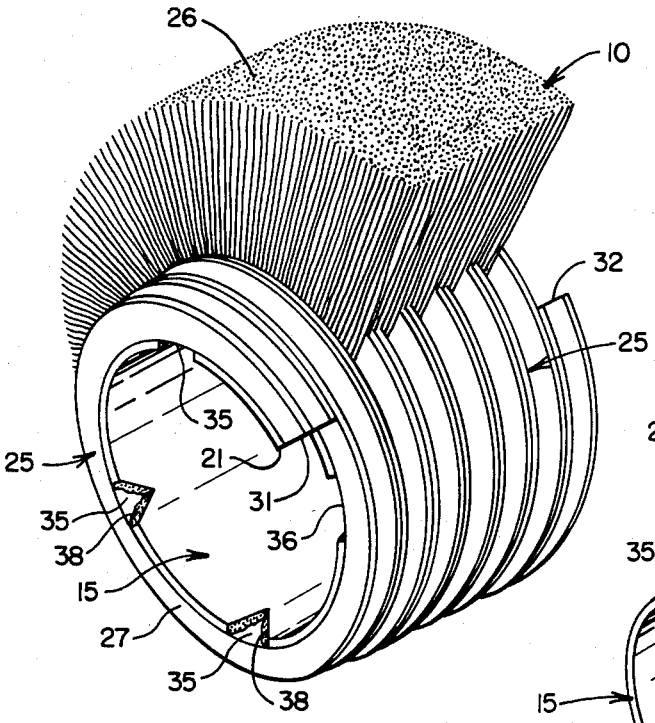
FIG. 5 is a perspective view of the brush section, with the strip mounted thereon but with bristles removed from the mounting channel for purpose of illustration, showing the section with the drum still offset.
Figure 5A:
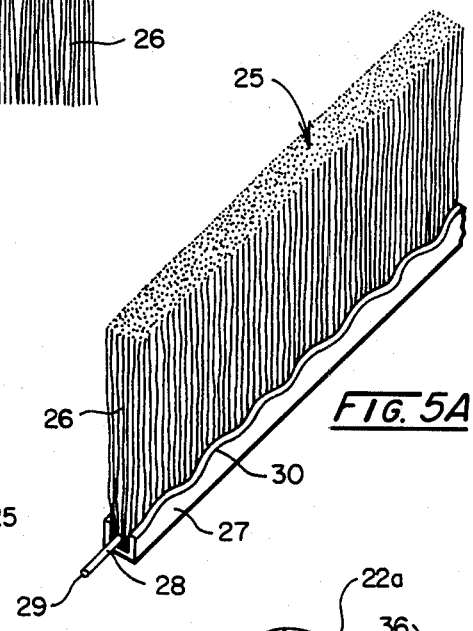
FIG. 5A is a perspective view of a bristle-carrying strip to be mounted on the drum.
Figure 4:
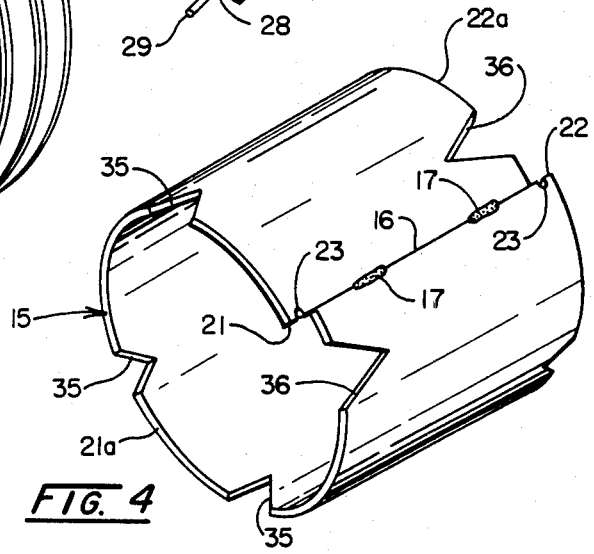
FIG. 4 is a perspective view of the offset support tube or drum used in making a brush section.

The brush strip used in forming the helical brush section 10 according to this invention is initially in the form of a straight strip shown in FIG. 5A and is indicated generally at 25. It comprises a metal channel 27 which has the bristles 26 of U-form with their closed ends disposed in the elongated metal channel. Extending through the U-shaped ends of the bristles is a retaining wire 28 and it will be noted that it projects beyond the adjacent ends of the channel at 29. The sides of the channel are crimped at 30, outwardly of the wire 28. Thus, the bristles will be retained as a continuous row in the channel.

Figure 3:
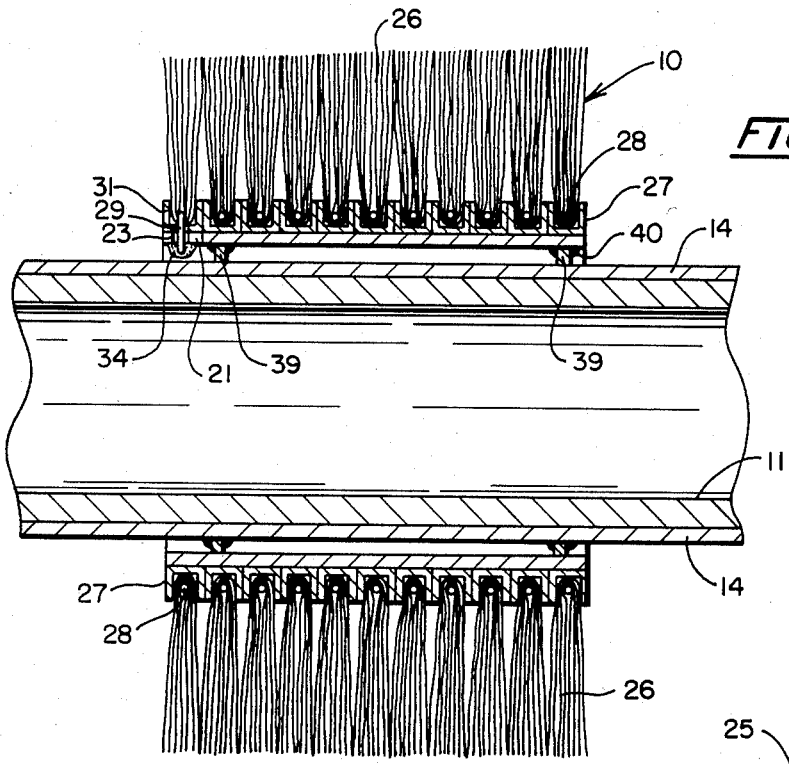
FIG. 3 is an axial section taken along line 3—3 of FIG. 2.

This straight brush strip 25 is wound helically around the offset drum 15 in convolutions as shown in FIG. 5 from one shoulder 21–22 to the other and is secured to the drum by welding it to the drum and also preferably fastening the projecting end wire 28 on the adjacent shoulder 21 or 22, as indicated in FIGS. 2 and 3. The ends 31 and 32 of the channel 27 correspond to the respective drum shoulders 21 and 22. The result is the continuous helical brush section 10 shown in these Figures. The section in this phase in shown with tight convolutions but the helix may have any desired pitch.

The ends 29 of the wire are bent radially inwardly into the respective notches 23 and then along the inner surface of drum 15 and are welded in place as indicated at 34 in FIGS. 2 and 3. To facilitate welding of the brush strip 25 to the drum 15, the drum end edges 21*a* and 22*a* are each provided with a series of V-notches 35 and one notch 36, the latter being deeper than the former and being located adjacent the drum joint 16. The notch 36 preferably extends inwardly to the extent of two convolutions of the brush strip 25 to permit welding of the channel 27 thereof to the drum as indicated at 37. The notches 35 are angularly spaced around the drum and are shown as extending inwardly for the extent of one convolution to permit welding of the strip channel 27 to the drum at angularly-spaced intervals as indicated at 38. The assembly in this condition is illustrated in FIG. 5 and it will be noted that the ends 31 and 32 of the brush section 25 are at the drum shoulders 21 and 22.

Figure 6:
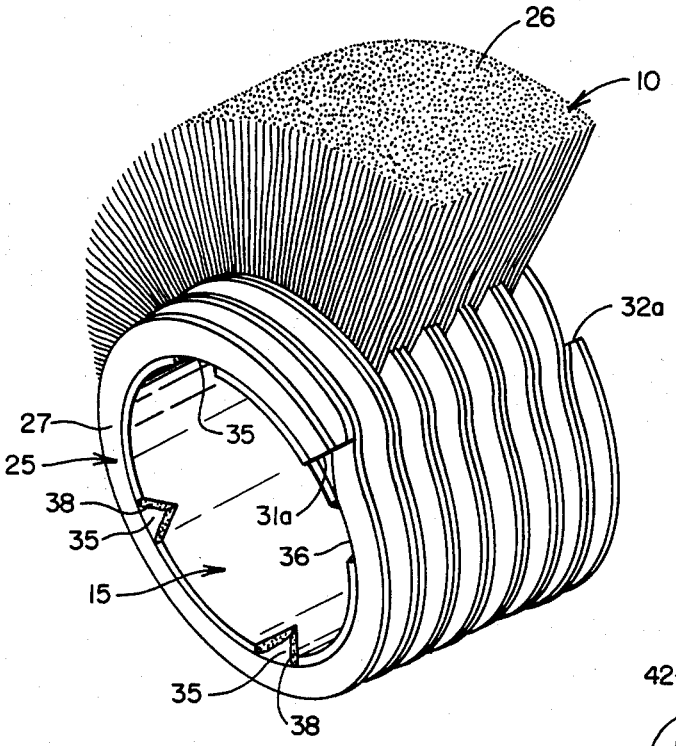
FIG. 6 is similar to FIG. 5 but showing the section after axial pressure which eliminates the offset of the drum.
Figure 6A:
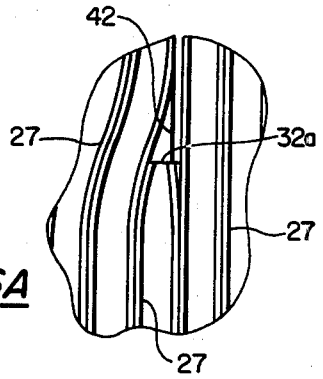

To finally form the brush section 10, the section with the offset drum 15 may be positioned between opposed press members which are moved towards each other to apply axial pressure. This breaks the tack welds 17 at the joint 16, or they may be ground off to cause the joint to slip and restore the drum to cylindrical form and simultaneously flatten the channel 27 at its ends 31 and 32 and distort the adjacent convolutions axially inwardly as indicated in FIG. 6. However, the welds 37 and 38 will not be disturbed. The result is that the offset of the drum 15 is eliminated and there is only a slight shoulder 31*a* and 32*a* at the respective ends 31 and 32 of the brush section channel 27 as indicated in FIGS. 6, 6A and 7, the distorted channel ends 31*a* and 32*a* being substantially flush with the corresponding drum ends 21*a* and 22*a*.

Within the drum 15, towards its opposed ends, driving collars 39 may have their peripheral edges welded to the inner surfaces of the drum by welds 40 as shown in FIG. 2. These collars on their inner edges have keyways 41 for receiving the mandrel splines 14. The collars 39 need not be located in this instance in a predetermined angular position within the drum.

As indicated, multiples of this brush section 10 are used in axially abutting relationship to form the complete rotary brush with a continuous helix substantially without gaps in the bristles at the ends 31 and 32 of the helical brush strips 25. To form the complete brush, the sections 10 are slipped axially onto the mandrel 11 from the end where the collar 12*a* is removed. When this collar is later replaced the sections 10 will be clamped axially against the stop collar 12. At this time the ends of adjacent sections 10 will abut axially so that the sections will function as a simple continuous helical rotary brush with substantially no bristle gap between adjacent sections. The drive from the mandrel 11 will be through splines 14 and collars 39.

Figure 7:
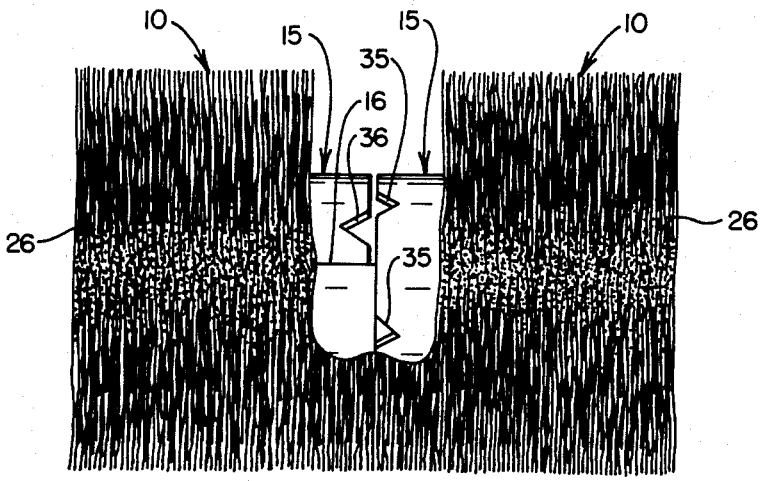

When mounting the brush sections 10 on the mandrel 11, it does not matter if the adjacent sections are angularly aligned as indicated in FIG. 7 which shows them non-aligned as determined by positioning them on the mandrel at relative positions of 180 degrees as located by splines 14 and keyways 41. As indicated in FIG. 6A the flattened end 32*a* of the one section will abut the surface of adjacent channel 27 and there will be only a slight gap 42 therebetween.

It will be apparent that the above invention provides for short simple helical brush sections which are easy to handle and assemble in abutting relationship as a continuous helical rotary brush. When mounted, which is a simple operation, their adjacent ends axially abut and there will be only very slight gaps in the bristles between adjacent brush sections.

Having thus described the invention, what is claimed is:

1. A helical brush section for use in axially-aligned relationship to form a rotary brush comprising a tubular bristle-carrying drum, a brush strip helically wound on the drum from one end to the other with its ends at the drum ends, said strip being formed of a channel which carries radially-projecting bristles, said ends of the brush strip having the corresponding channel ends distorted inwardly substantially flush with the corresponding drum ends, said tubular support being rolled sheet metal joined at a longitudinal joint where the adjacent edges of the sheet are offset longitudinally to form opposed end helical edges and shoulders and the brush strip is helically wound thereon until its ends correspond to the shoulder and the drum is restored by axial pressure to cylindrical form which distorts the ends of the channel substantially flush with the drum ends.

2. A helical brush section according to claim 1 in which the bristle-carrying brush strip is wound helically about the drum in convolutions of selected pitch from one drum end to the other and is secured thereto at a plurality of angular positions.

3. A helical brush section according to claim 2 in which the bristle-carrying strip is in the form of a channel having bristles of U-form mounted therein with their closed ends in the channel, and a retaining wire extends through such ends and beyond the adjacent ends of the channel with such ends secured to said tubular support.

4. A helical brush-section according to claim 3 in which the drum has notches in its ends to provide edges where it is welded to the channel.

5. A helical brush section according to claim 4 in which the shoulders of the offset drum have notches into which the respective ends of the retaining wire are bent radially inwardly and then over the inner surface of the drum.

6. An assembly of helical brush sections of the structure defined in claim 2 disposed on a mandrel in abutting axial contact at the drum ends.

7. An assembly according to claim 6 including means for clamping the sections in axial contact on the mandrel.

8. The method of forming a helical brush section which comprises forming a tubular support by offsetting the adjacent edges of a longitudinally-split tube at the split thereof to form opposed helical edges at its ends terminating in shoulders, and mounting thereon a helically-extending bristle-carrying strip with its ends corresponding to the shoulders and then subjecting the assembly to axial pressure to eliminate the offset of the tube so it is of substantially cylindrical form with the ends of the strip distorted to substantially flush relationship with the tube ends.

9. The method of claim 8 in which the strip is formed as a channel with radially-projecting bristles, and winding the strip on the tube helically from one shoulder to the other and attaching the strip to the tube before applying the axial pressure.

10. The method of claim 9 in which the attaching is by welding at nothces formed at the ends of the tube to the channel of the brush strip.

11. The method of claim 10 in which driving collars are welded within the drum at axially-spaced positions.

12. The method of claim 7 in which the strip has U-shaped bristles held in the channel by means including a retaining wire having ends extending beyond the channel which is bent into notches at the tube shoulders into contact with its inner surface where they are welded thereto.

* * * * *